US006018963A

United States Patent [19]

Itoh et al.

[11] Patent Number: 6,018,963

[45] Date of Patent: Feb. 1, 2000

[54] REFRIGERATION CYCLE

[75] Inventors: Masaaki Itoh; Mari Uchida; Mitsuo Kudoh; Toshihiko Fukushima, all of Tsuchiura; Tadao Otani, Ibaraki-ken, all of Japan

[73] Assignees: Hitachi, Ltd; Hitachi Cable Ltd., both of Tokyo, Japan

[21] Appl. No.: 09/123,466

[22] Filed: Jul. 28, 1998

Related U.S. Application Data

[62] Division of application No. 08/497,804, Jul. 3, 1995.

[30] Foreign Application Priority Data

Jul. 1, 1994 [JP] Japan ..... 6-150785
Nov. 24, 1994 [JP] Japan ..... 6-289455

[51] Int. Cl.[7] ..... F25B 39/00

[52] U.S. Cl. ..... 62/527; 62/502; 165/133

[58] Field of Search ..... 62/502, 527, 506, 62/507, 515; 165/DIG. 515, 133

[56] References Cited

U.S. PATENT DOCUMENTS 4,166,498 9/1979 Fujie et al. ..... 165/133

5,458,191 10/1995 Chiang et al. ..... 165/133

*Primary Examiner*—Harry B. Tanner

*Attorney, Agent, or Firm*—Antonelli, Terry, Stout & Kraus, LLP

[57] ABSTRACT

In a heat transfer tube for a zeotropic refrigerant mixture, the inner surface of the tube in which the zeotropic refrigerant mixture flows is formed with grooves having cross portions where the grooves intersect with each other, or the inner surface of the tube is formed with a plurality of independent projections. Thus, concentration boundary layers generated in the zeotropic refrigerant mixture are stirred to reduce the thickness of the concentration boundary layers, thereby decreasing the diffusion resistance and promoting the stirring effect. Consequently, there can be provided a heat transfer tube for a zeotropic refrigerant mixture which exhibits a high heat transfer performance, and a heat exchanger of a cross-fin tube type, a refrigerator and an air conditioner which include such heat transfer tubes.

6 Claims, 14 Drawing Sheets

REFRIGERATION CYCLE

This application is a divisional application of U.S. Ser. No. 08/497,804, filed Jul. 3, 1995.

BACKGROUND OF THE INVENTION

The present invention relates to a heat exchanger for use in a refrigerator or an air conditioner in which a zeotropic refrigerant mixture is employed as an operating fluid and, more particularly, to a condenser or an evaporator of a heat exchanger of a cross-fin tube type, and a heat transfer tube suitably used for the heat exchanger.

A refrigerant HCFC-22 which has conventionally been used for air conditioners and the like is now regarded as a cause of environmental destruction. Especially, emission of this refrigerant into the atmospheric air has a serious influence on the ozone layer surrounding the earth. Therefore, researches have been made for various substitutes for the refrigerant HCFC-22.

As a result, it was found difficult to use a single refrigerant as a substitute. Consequently, application of a zeotropic refrigerant mixture consisting of two or three kinds of refrigerants has been studied.

However, the following problem is disclosed in "Heat Transfer Coefficient of HFC's Zeotropic Refrigerant Mixtures in a Horizontal Grooved Tube" (Collection of Lecture Theses at the 30th National Heat Transfer Sympostium of Japan, 1993, Yokohama, Vol. 1, PP. 337 –339, published on May 26, 1993). A plain tube and a tube with inner helical grooves (the so-called micro-fin tube) extending at one helical angle shown in FIG. 5 have conventionally been used for a single refrigerant in most cases. When the structure of such a conventional tube is applied to a heat transfer tube with a zeotropic medium in order to constitute an actual cycle system, the heat transfer performance which is a particular phenomenon to the heat transfer tube is unfavorably deteriorated. Accordingly, it is an important matter to improve the performance of a heat transfer tube in a heat exchanger by a novel structure.

More specifically, the conventional tube with inner helical grooves of a single kind exhibits an excellent heat transfer performance with respect to a single refrigerant. However, the HFC zeotropic refrigerant mixture consisting of two or three kinds of refrigerants, which has been regarded as the likeliest substitute for the refrigerant HCFC-22, can not produce an effect as high as the single refrigerant.

FIG. 9 shows test results of condensation heat transfer coefficient when the conventional tube with inner helical grooves is used, in which a curve a indicates a test result of the single refrigerant, and a curve b indicates a test result of the zeotropic refrigerant mixture. Obviously, the condensation heat transfer coefficient of the zeotropic refrigerant mixture is lower than that of the single refrigerant. The zeotropic refrigerant mixture used in the tests consists of HFC-32, HFC-125 and HFC-134a by the amount of 30 wt %, 10 wt % and 60 wt %, respectively.

It is a first object of the invention to provide a heat transfer tube for a zeotropic refrigerant mixture which exhibits a high heat transfer performance.

It is a second object of the invention to provide a heat exchanger or an air conditioner for a zeotropic refrigerant mixture which exhibits a high heat transfer performance.

SUMMARY OF THE INVENTION

In order to achieve the first object, according to the present invention, there is provided a heat transfer tube for use in at least one of a condenser and an evaporator (hereinafter both referred to as a heat exchanger) in a refrigeration cycle system with a zeotropic refrigerant mixture, wherein the inner surface of the tube is formed with grooves having cross portions at which the grooves intersect with each other.

Also, there is provided a heat-transfer tube for use in at least one heat exchanger in a refrigeration cycle with a zeotropic refrigerant mixture, wherein the inner surface of the tube is formed with a plurality of independent projections.

Further, there is provided a heat transfer tube for use in at least one heat exchanger in a refrigeration cycle with a zeotropic refrigerant mixture, wherein the tube includes at least one spring provided in grooves along the inner surface of the tube, or there is provided a heat transfer tube for use in at least one heat exchanger in a refrigeration cycle with a zeotropic refrigerant mixture, wherein the tube includes springs which are provided on an inner surface of the tube and intersect with each other.

Moreover, there is provided a heat transfer tube for use in at least one heat exchanger in a refrigeration cycle with a zeotropic refrigerant mixture, wherein the tube includes a plurality of helical ridges or ribs formed on the inner surface of the tube, and secondary grooves which are formed in the inner surface of the tube and cross the ridges.

Also, there is provided a heat transfer tube for use in at least one heat exchanger in a refrigeration cycle with a zeotropic refrigerant mixture, wherein the tube includes three-dimensional projections, segmental fins or louvered fins which are formed on the inner surface of the tube and project into the vapor flow or liquid thin-layer flow within the tube, so that the projections or fins divide concentration boundary layers of the zeotropic refrigerant mixture in order to decrease the diffusion resistance.

Furthermore, there is provided a heat transfer tube for use in at least one heat exchanger in a refrigeration cycle with a zeotropic refrigerant mixture, wherein the tube includes a plurality of helical ridges or ribs which are formed on the inner surface of the tube and extend at a helical angle of 10 to 20 degrees with respect to the axis of the tube, the ridges having a pitch $P_{f1}$ such that when an inner diameter of the heat transfer tube is denoted by $D_i$, a ratio $P_{f1}/D_i$ is within a range of 0.05 to 0.1, and secondary grooves which are formed in the inner surface of the tube and cross the ridges, the secondary grooves having a depth $H_{f2}$ which is set within a range of 40 to 100% of a height $H_{f1}$ of the ridges. The secondary grooves which cross the ridges have a width $W_{f2}$ which is set between a top width $W_t$ of the ridges and a bottom width $W_b$ of the ridges.

In order to achieve the second object, according to the invention, there is provided a heat exchanger for use in a refrigeration cycle with a zeotropic refrigerant mixture, wherein a plurality of fins are provided substantially in parallel to one another, and heat transfer tubes according to the present invention penetrate through the fins and are securely fixed therein.

Also, there is provided a heat exchanger for use in a refrigeration cycle with a zeotropic refrigerant mixture, wherein a plurality of fins are provided substantially in parallel to one another, and heat transfer tubes according to claim 9 are applied with a fluid pressure and expanded to be securely fixed in the fins.

Further, there is provided a method of assembling a heat exchanger for use in a refrigeration cycle with a zeotropic refrigerant mixture, which heat exchanger is of a cross-fin tube type, comprising the steps of: making heat transfer tubes according to the present invention penetrate through fins; and applying a fluid pressure to the inner surfaces of the heat transfer tubes so as to expand the tubes and to securely fix the tubes in the fins.

Moreover, there are provided a refrigerator and an air conditioner of a refrigeration cycle with a zeotropic refrigerant mixture, wherein a heat exchanger according to the present invention is used for at least one heat exchanger which constitutes the refrigeration cycle.

With the above-described structure, new concentration boundary layers can be developed from the distal ends of the three-dimensional projections, segmental fins or louvered fins which are formed on the inner surface of the tube and project into the vapor flow or liquid thin-layer flow, to thereby decrease the diffusion resistance. As a result, there can be provided a heat transfer tube of a high heat transfer coefficient with respect to the zeotropic refrigerant mixture.

Further, according to the invention, the heat transfer tube for the zeotropic refrigerant mixture includes inner grooves having cross portions where the grooves intersect with each other, or a plurality of independent projections formed on the inner surface thereof, so as to promote the stirring effect of the zeotropic refrigerant mixture which flows within the tube, and also to decrease non-uniformity in the concentration distribution generated in the zeotropic refrigerant mixture. In consequence, there can be provided a heat transfer tube of a high heat transfer coefficient with respect to the zeotropic refrigerant mixture.

By using the above-described heat transfer tubes, there can be provided a heat exchanger for a zeotropic refrigerant mixture which has a high refrigerant-side heat transfer coefficient.

By using such heat exchangers, there can be provided a refrigerator and an air conditioner for a zeotropic refrigerant mixture which are highly efficient and compact.

DETAILED DESCRIPTION OF THE PREFERRED EMBODIMENTS

Figure 1:
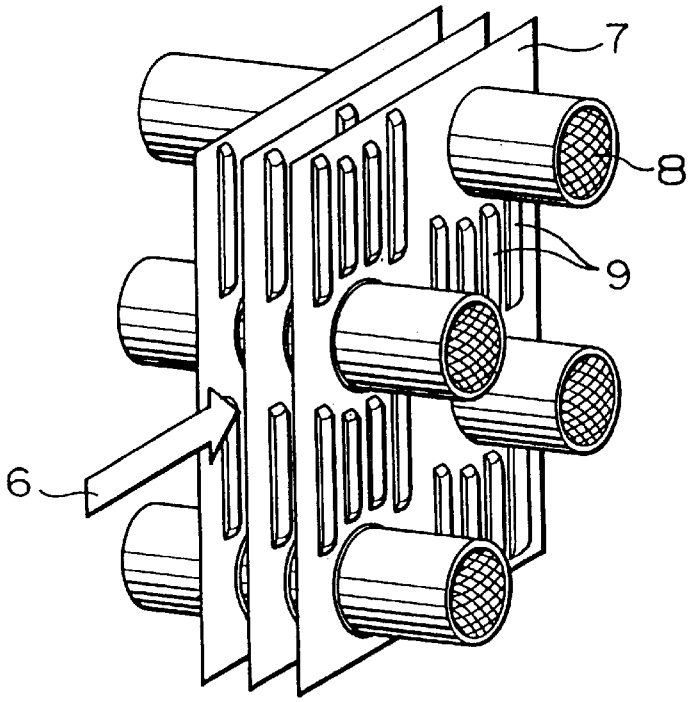
FIG. 1 is a perspective view partially showing a heat exchanger of a cross-fin tube type according to a first embodiment of the present invention.
Figure 2:
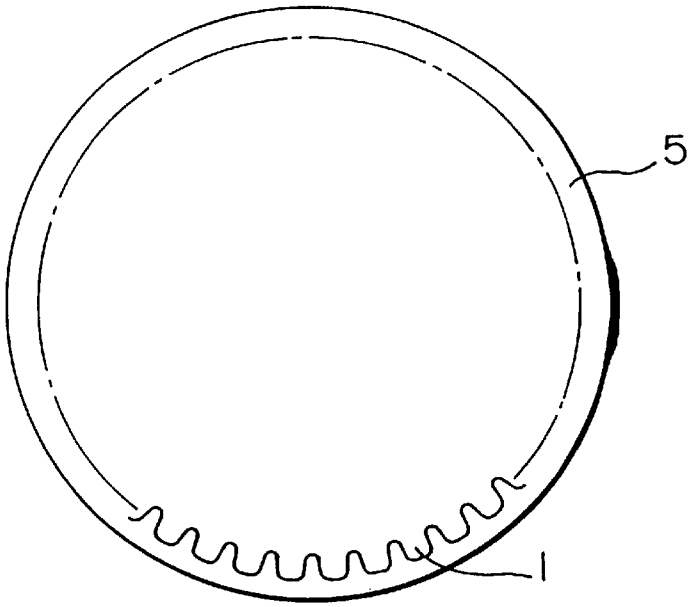
FIG. 2 is a horizontal cross-sectional view of a heat transfer tube used for a conventional heat exchanger.
Figure 3:
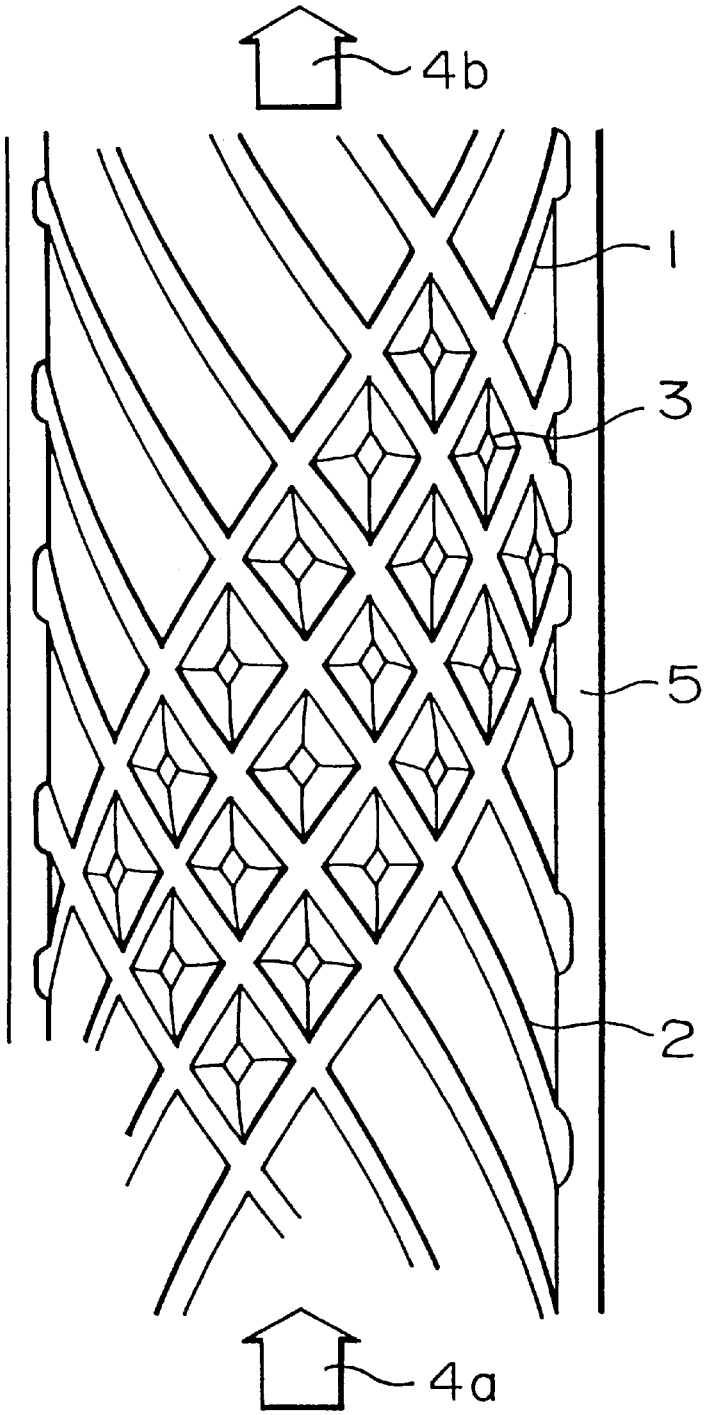
FIG. 3 is a vertical cross-sectional view showing a heat transfer tube of the first embodiment.
Figure 4:
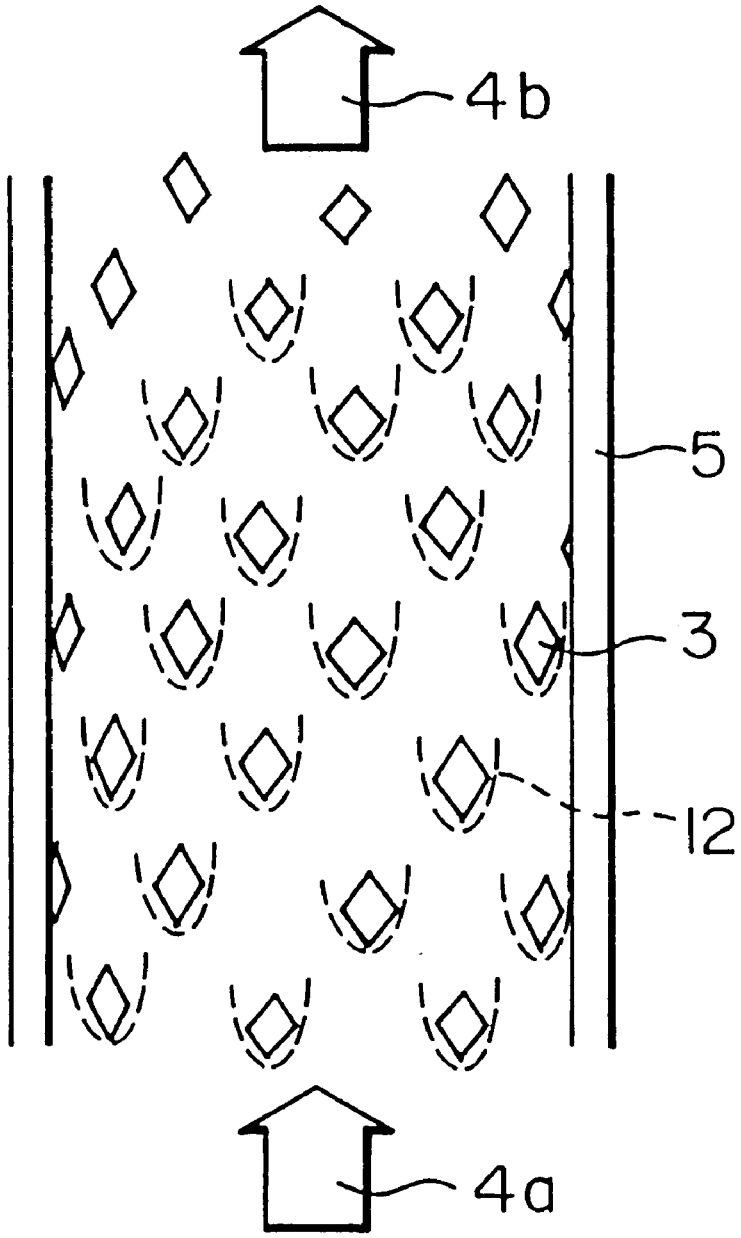
FIG. 4 is a vertical cross-sectional view showing a modification of the heat transfer tube of the first embodiment.
Figure 5:
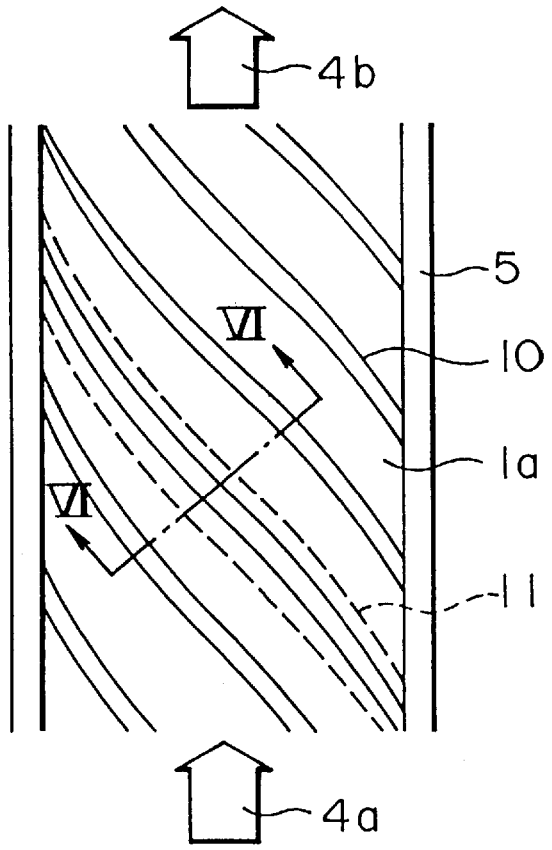
FIG. 5 is a vertical cross-sectional view of a conventional tube with helical grooves.
Figure 6:
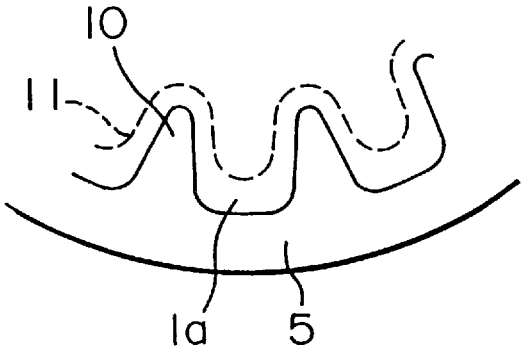
FIG. 6 is a horizontal cross-sectional view partially showing the conventional tube with helical grooves.
Figure 7:
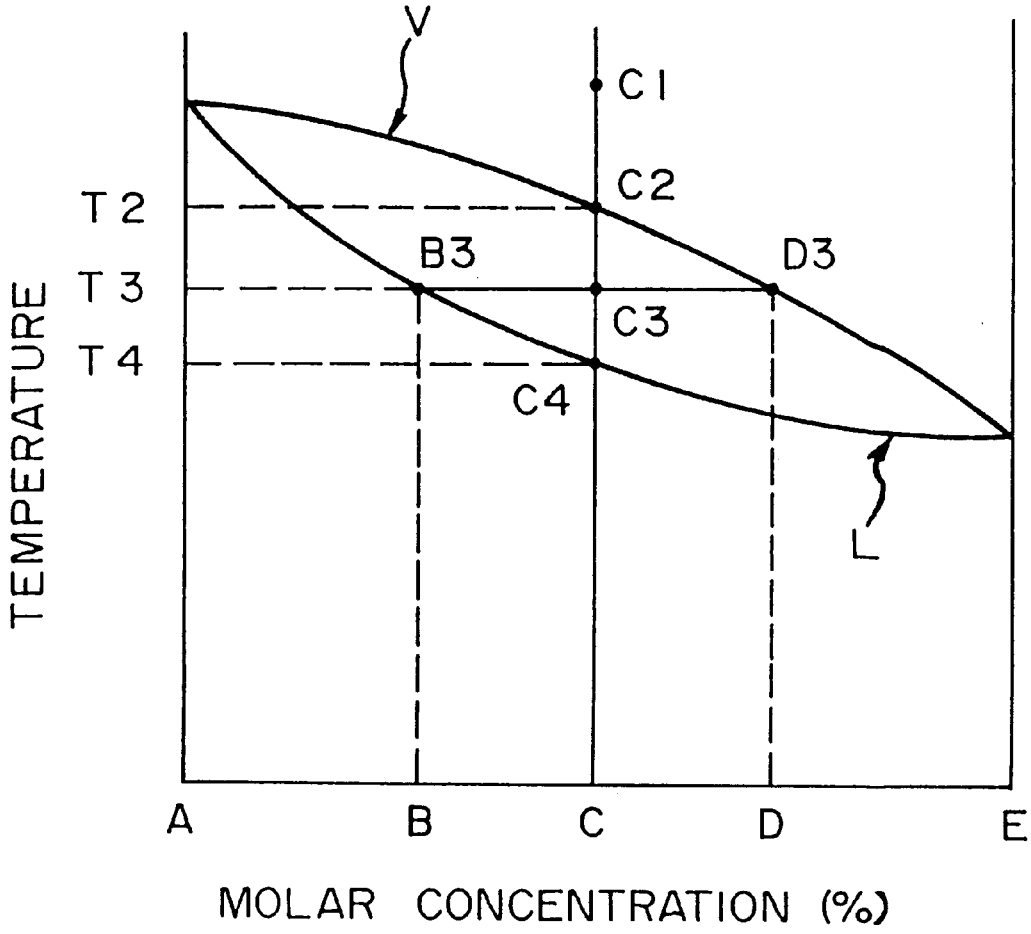
FIG. 7 is a phase diagram of a zeotropic refrigerant mixture.
Figure 8:
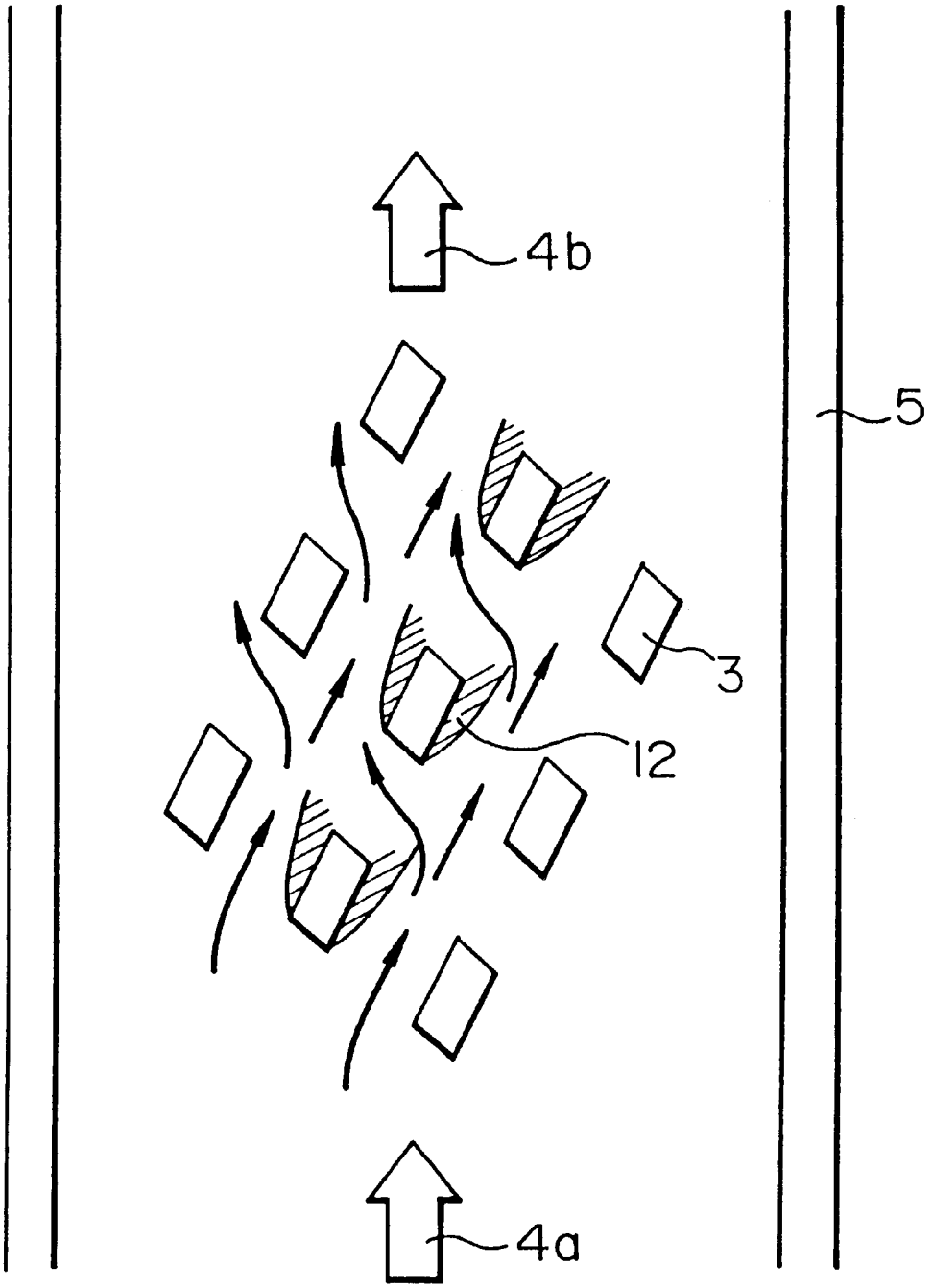
FIG. 8 is a vertical cross-sectional view of the heat transfer tube of the first embodiment, showing concentration boundary layers and streamlines of a zeotropic refrigerant mixture which flows through separated ribs.
Figure 9:
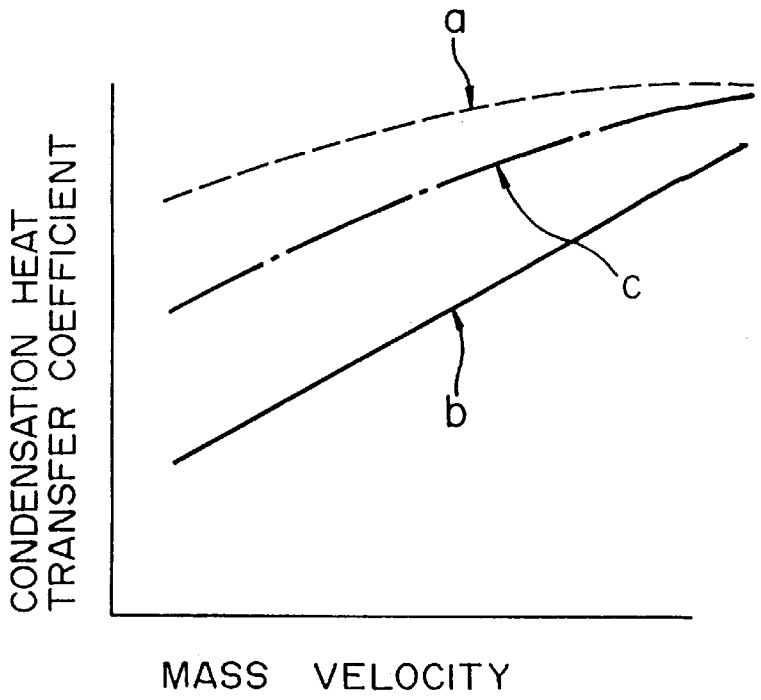
FIG. 9 is a graph for comparing the heat transfer coefficients of the conventional tube with helical grooves when a single refrigerant and a zeotropic refrigerant mixture are used, with the heat transfer coefficient of the heat transfer tube of the first embodiment when a zeotropic refrigerant mixture is used.

A first embodiment of the present invention and a modification thereof will be hereinafter described with reference to FIGS. 1 to 9. FIG. 1 is a perspective view partially showing a heat exchanger of a cross-fin tube type in the first embodiment; FIG. 2 is a horizontal cross-sectional view of a heat transfer tube for a conventional heat exchanger; FIGS. 3 and 4 are vertical cross-sectional views showing heat transfer tubes of the first embodiment and its modification, respectively; FIG. 5 is a vertical cross-sectional view of a conventional tube with helical grooves; FIG. 6 is a horizontal cross-sectional view partially showing the conventional tube with helical grooves; FIG. 7 is a phase diagram of a zeotropic refrigerant mixture; FIG. 8 is a vertical cross-sectional view of the heat transfer tube of the first embodiment, showing concentration boundary layers and streamlines of a zeotropic refrigerant mixture which flows through independent projections in the first embodiment; and FIG. 9 is a graph for comparing the heat transfer coefficients of the conventional tube with helical grooves when a single refrigerant and a zeotropic refrigerant mixture are used, with that of the heat transfer tube of the first embodiment when a zeotropic refrigerant mixture is used.

FIG. 1 partially shows the heat exchanger according to the first embodiment of the invention. In the heat exchanger of the first embodiment, a plurality of fins 7 are provided substantially in parallel to one another, and a plurality of heat transfer tubes 8 are inserted through the fins 7. Louvers 9 are formed on the surface of each fin 7 among the heat transfer tubes 8 by cutting portions of the fin 7 and slightly raising them. When the air is blown from a fan (not shown) in a direction in parallel to the fins 7 which is indicated by the arrow 6, the air flows through the fins 7 and the louvers 9. On the other hand, a zeotropic refrigerant mixture flows within the heat transfer tubes 8 and exchanges heat with the air.

As shown in the first embodiment of FIG. 3 or in the modification of the first embodiment of FIG. 4, independent projections 3 are formed on the inner surface of each heat transfer tube 8 and raised from a tube wall 5. These independent projections 3 can be provided by forming cross grooves 1 and 2 in the tube wall 5 to define projecting portions, as shown in FIG. 3, or by grinding the tube wall 5 in a cross pattern to define rhombic projecting portions, as shown in FIG. 4. Also, the independent projections 3 can be provided by pressing an outer wall of the heat transfer tube 8 although not shown.

Before explaining the function and effect of the heat transfer tube of this embodiment, a conventional tube with inner helical grooves will be described with reference to FIGS. 5 and 6. As shown in FIG. 5, grooves 1*a* in a helical pattern are formed in a tube wall 5. Generally, the inner diameter of the tube is 6 to 10 mm; the groove depth is 0.1 to 0.3 mm; the groove pitch is 0.1 to 0.3 mm; the angle of the helical grooves 1*a* is 0 to 25 degrees; the shape of the grooves 1*a* is a trapezoid; and the angle of distal portions of fins is 30 to 40 degrees. A speculation will now be given on the case where a refrigerant mixture consisting of two kinds of refrigerants, e.g., HFC-32 and HFC-134a, flows in the tube with helical grooves and is condensed.

FIG. 7 is a phase diagram of the zeotropic refrigerant mixture, in which the abscissa represents the molar concentration (%) of one of the refrigerants, HFC-32 in this case, and the ordinate represents the temperature. In FIG. 7, the residual molar concentration (%) in the zeotropic refrigerant mixture is that of another refrigerant, HFC-134a. A curve V of FIG. 7 is called a dew point line and expresses the temperature at which condensation starts. At a temperature above the curve V, the zeotropic refrigerant mixture is in a gaseous state. A curve L is called a boiling-point line. At a temperature below the curve L, the zeotropic refrigerant mixture is in a liquid state. The zeotropic refrigerant mixture in a gaseous state C1, with HFC-32 having a molar concentration at a level C, is gradually cooled and changed into a liquid state. In this process, when vapor in the state C1 is cooled down to a temperature T2, the vapor reaches the dew point and starts condensation, and its temperature is lowered from a level T3, and when the vapor reaches a temperature T4, condensation is completed.

The zeotropic refrigerant mixture is characterized in that the condensation temperature is not constant but varies within a certain range, and that the liquid which is condensed and the vapor which remains uncondensed have different concentrations. More specifically, as shown in FIG. 7, at the temperature T3, the refrigerant mixture does not have HFC-32 by the molar concentration (%) of C, and the refrigerant mixture is divided into condensed liquid having HFC-32 by the molar concentration (%) of B and vapor having HFC-32 by the molar concentration (%) of D. If a zeotropic refrigerant mixture of such characters flowing in the tube with helical grooves shown in FIG. 5, the condensation performance is deteriorated.

The reasons will be described below. The refrigerant HFC-32 tends to be condensed less easily than HFC-134a. Therefore, on the condensation surface, liquid of the refrigerant mixture having a high concentration of HFC-134a is condensed, and vapor of the refrigerant mixture having a high concentration of HFC-32 remains uncondensed. As a result, a concentration distribution occurs on the vapor-liquid interface. Especially, a region on the vapor side where the concentration of HFC-32 is higher (hereinafter referred to as a concentration boundary layer) impedes condensation of vapor of the refrigerant mixture having the concentration C of HFC-32 which exists in a central portion of the tube, thereby deteriorating the condensation performance. In the tube with helical grooves, as shown in FIG. 5, refrigerant gas in the vicinity of the tube wall 5 is moved along the helical grooves 1*a* and ridges 10 between the grooves, and flows in a direction of the helical grooves 1*a*. In the case of a zeotropic refrigerant mixture, a refrigerant which is relatively easy to condense and a refrigerant which is relatively difficult to condense are mixed, and consequently, the former is first condensed into liquid whereas the latter remains in a gaseous state, thus forming concentration boundary layers. As shown in FIG. 5, concentration boundary layers 11 in the tube with inner helical grooves are formed along the helical grooves 1*a*. As shown in FIG. 6, since the concentration boundary layers 11 are formed continuously, their thickness is gradually increased, as indicated by dashed lines in FIG. 5, and these concentration boundary layers prevent the refrigerant which is relatively easy to condense from being diffused over the tube wall 5. Especially, as shown in FIG. 6, in the groove portions where the temperature is low and the refrigerant mixture flows at low speed, uncondensed gas is accumulated by a remarkable degree to form layers which resist diffusion of gas to be condensed, thereby impeding condensation of gas and degrading heat transfer coefficient of the zeotropic refrigerant mixture.

In the heat transfer tube of the first embodiment, the ridges between the grooves are separated into the projections 3 by the cross portions of the grooves. In connection, the cross grooved tube intersected by two different grooves, which is used for a single refrigerant, is disclosed in the Japanese Patent Unexamined Publication No. 3-234302. Further, there have been proposed heat transfer tubes having various inside patterns in order to use for a single refrigerant.

However, it has been not found what inside pattern or shape should give high heat transfer coefficient to a heat transfer tube using for a zeotropic refrigerant mixture. As described in the following embodiments, it has been first found by the present inventors that the cross grooved tube can achieve high heat transfer coefficient in using for a zeotropic refrigerant mixture.

The first embodiment of the present invention will be hereinafter described in detail. In the first embodiment, the projections 3 are formed as described above, and consequently, flows of refrigerant vapor or refrigerant liquid thin-layer flows collide against the independent projection 3. Therefore, as shown in FIG. 8, a concentration boundary layer 12 individually develops from the upstream end of each independent projection 3 so that the thickness of the concentration boundary layer 12 will be reduced. As a result, the resistance against diffusion of the refrigerant concentration is decreased, to thereby obtain a high mass transfer coefficient. Moreover, the independent projection 3 serve to stir flows of vapor and condensed liquid of the zeotropic refrigerant mixture effectively.

As one example, in FIG. 9, condensation heat transfer coefficient of the conventional tube with helical grooves when the zeotropic refrigerant mixture is used is indicated by a curve b, and condensation heat transfer coefficient of the tube of the first embodiment when the zeotropic refrigerant mixture is used is indicated by a curve c. As clearly understood from FIG. 9, the condensation heat transfer coefficient of the tube of the first embodiment with the zeotropic refrigerant mixture is higher than that of the conventional tube with helical grooves.

The heat exchanger as a condenser has been described above. However, when the heat exchanger is used as an evaporator, concentration boundary layers formed in liquid of zeotropic refrigerant mixture are divided by independent projections, and the concentration boundary layers are stirred by these projections, so that a high heat transfer coefficient can be obtained in the case of evaporation as well.

Figure 10:
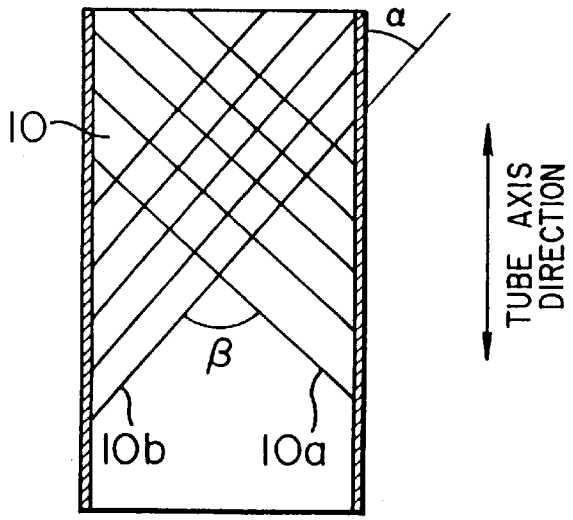
FIG. 10 is a vertical cross-sectional view of a heat transfer tube according to a second embodiment of the invention.
Figure 11:
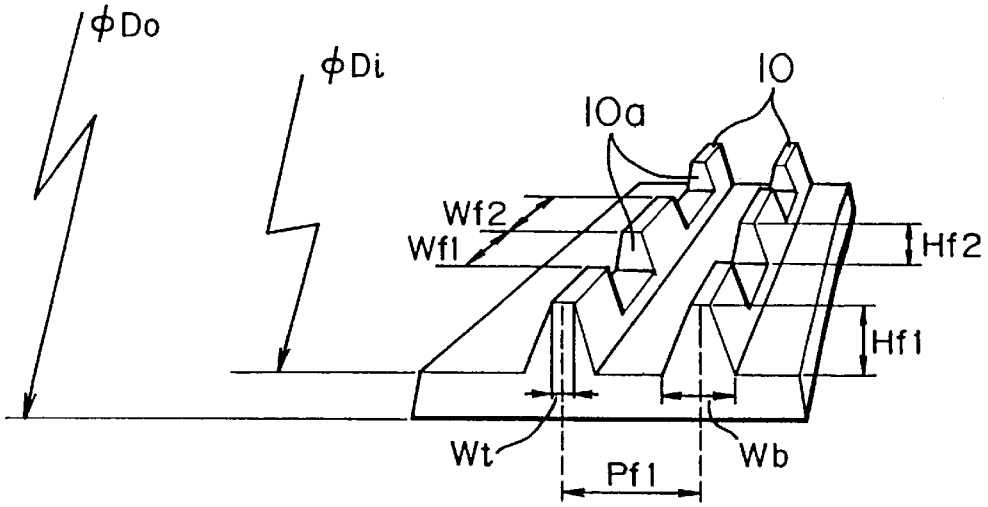
FIG. 11 is a perspective view partially showing the heat transfer tube of the second embodiment.
Figure 12:
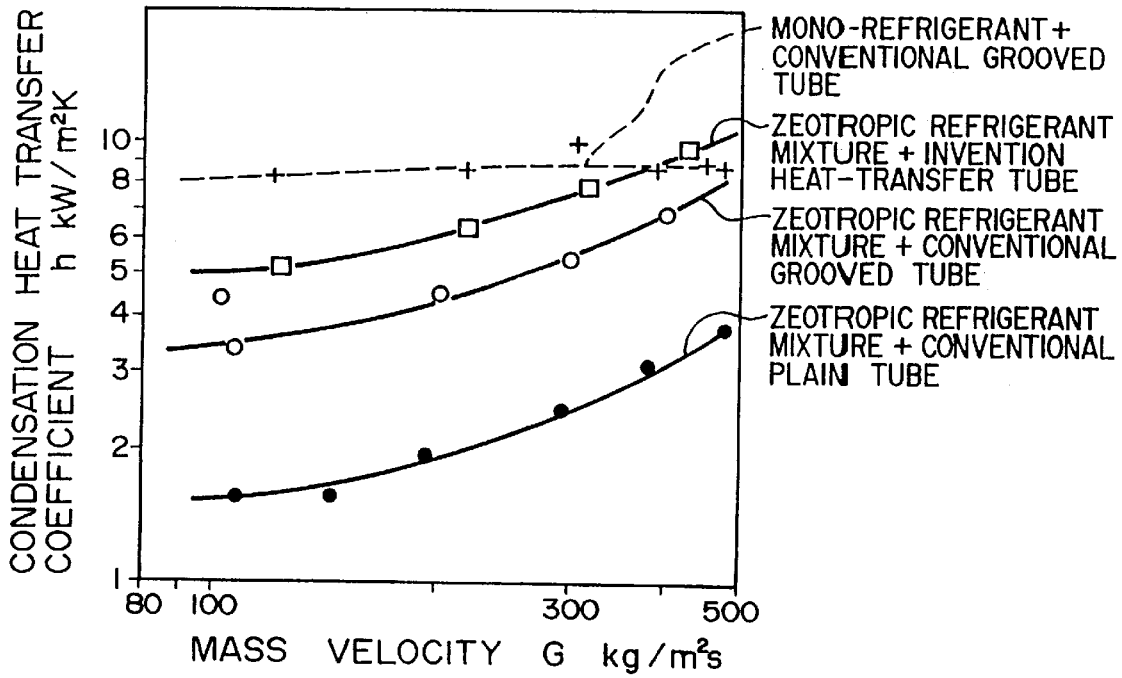
FIG. 12 is a graph for comparing the condensation heat transfer coefficients of the conventional tube with helical grooves when a single refrigerant and a zeotropic refrigerant mixture are used, with the condensation heat transfer coefficient of the heat transfer tube of the second embodiment when a zeotropic refrigerant mixture is used.
Figure 13:
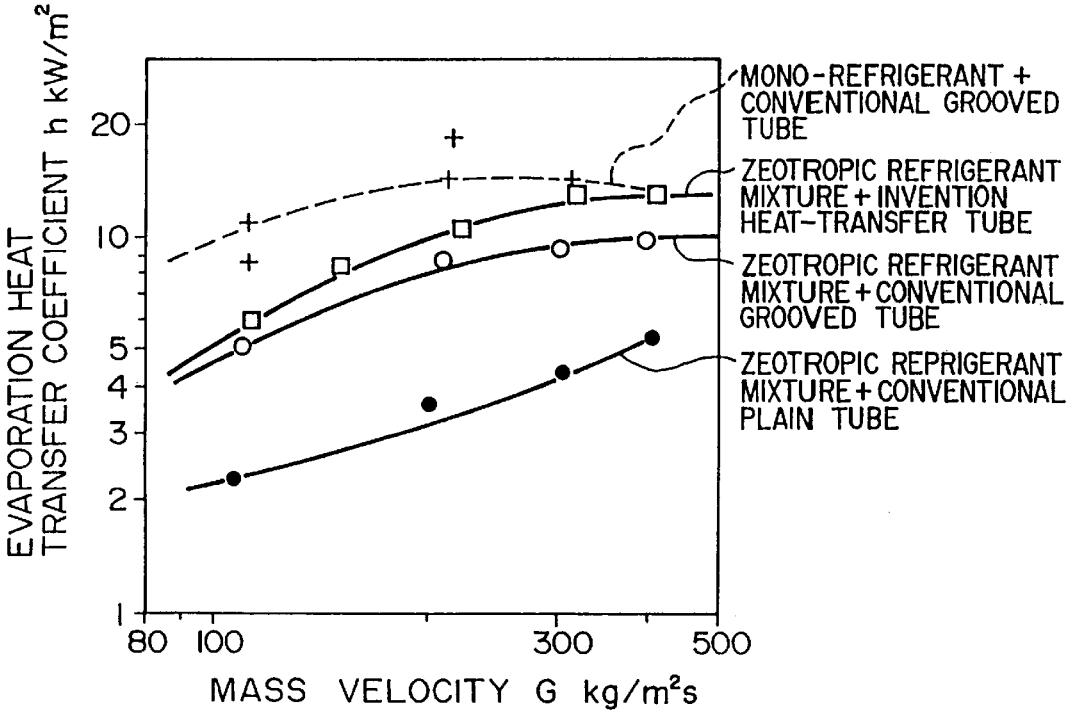
FIG. 13 is a graph for comparing the evaporation heat transfer coefficients of the conventional tube with helical grooves when a single refrigerant and a zeotropic refrigerant mixture are used, with the evaporation heat transfer coefficient of the heat transfer tube of the second embodiment when a zeotropic refrigerant mixture is used.

A second embodiment according to the present invention will now be described with reference to FIGS. 10 to 13. FIG. 10 is a vertical cross-sectional view of a heat transfer tube in the second embodiment; FIG. 11 is a perspective view partially showing the heat transfer tube in the second embodiment; and FIGS. 12 and 13 are graphs showing test results.

Projections in the second embodiment are provided as follows. As shown in FIGS. 10 and 11, ridges 10 having a height $H_{f1}$ are formed at a pitch $P_{f1}$, and secondary grooves 10*a* having a depth $H_{f2}$ are formed in the ridges 10 so as to define cross portions. Primary grooves for defining the ridges 10 extend at a helical angle $\alpha$, and the secondary grooves cross (or intersect) the ridges 10 and extend at an intersecting angle $\beta$.

According to the results of tests or the like, the inner diameter $D_i$ of a commonly used heat transfer tube is 3.0 to 7.0 mm, and in the case of this heat transfer tube, the ratio $H_{f1}/D_i$ of the height of the ridges 10 with respect to the inner diameter $D_i$ is preferably about 0.03 to 0.1, and the ratio $P_{f1}/D_i$ of the pitch of the ridges 10 with respect to the inner diameter $D_i$ is suitably about 0.05 to 0.1. The depth $H_{f2}$ of the secondary grooves is preferably 40 to 100% of the depth $H_{f1}$ of the primary grooves which define the ridges 10. The depth $H_{f2}$ of the secondary grooves is determined in this manner because if the secondary grooves are too shallow, the effect of liquid thin-layer to stir the interface is reduced, and the condensed liquid is impeded from flowing along the secondary grooves. Thus, when the depth $H_{f2}$ of the secondary grooves is too small, the effect of promoting heat transfer with respect to a zeotropic refrigerant mixture can not be obtained. In order to change the performance of a heat exchanger, the pitch $P_{f1}$ of the ridges 10 can be decreased or increased.

The width $W_{f2}$ of the secondary grooves influences the cross-sectional shape of the ridges 10. For example, it is presumed that the cross-sectional shape of the ridges 10 is substantially rectangular, and that the height of the ridges 10 is constant. If the ratio $W_t/W_b$ between the bottom width $W_b$ of the ridges 10 and the top width $W_t$ of the ridges 10 is close to 1 when the width $W_{f2}$ is larger than the bottom width $W_b$, the apparent heat transfer area is smaller than when the secondary grooves are not formed. Therefore, the width $W_{f2}$ is preferably determined within the range between $W_t$ and $W_b$. The cross-sectional shape of the secondary grooves may be a rectangle, a V-shape or any other shape. Portions of the ridges 10 can be inclined to form recesses.

When the depth $H_{f1}$ of the primary grooves which define the ridges 10 is constant, the ratio $W_t/W_b$ between the bottom width $W_b$ of the ridges 10 and the top width $W_t$ of the ridges 10 is preferably not more than 0.5. By designing the cross-sectional shape of the ridges 10 in the above-described manner, the cross-sectional area of the ridges 10 and the groove portions surrounded by the ridges 10 can be increased without decreasing the heat transfer area.

The angle $\beta$ at which the secondary grooves intersect the primary grooves is preferably 1.5 to 4 times larger than the helical angle $\alpha$ of the primary grooves when the primary grooves are twisted at a helical angle $\alpha$ of 10 to 20 degrees.

Measurement results of the performance of the heat transfer tube of the above-described structure with a zeotropic refrigerant mixture are shown in FIGS. 12 and 13. FIG. 12 is a graph for comparing the performances of various kinds of heat transfer tubes, in which the abscissa represents the mass velocity of the refrigerant, and the ordinate represents the condensation heat transfer coefficient, and FIG. 13 is a graph for comparing the performances of various kinds of heat transfer tubes, in which the abscissa represents the mass velocity of the refrigerant, and the ordinate represents the evaporation heat transfer coefficient when the heat flux is 10 $kW/m^2$ and the (vapor) quality is 0.6. As easily understood from FIGS. 12 and 13, when the zeotropic refrigerant mixture is used, the performance of the conventional tube with helical grooves is drastically deteriorated, but the heat transfer tube of the second embodiment exhibits a value close to that of the performance of a single refrigerant HCFC-22 and the conventional tube with helical grooves which is indicated by a dashed line. When compared with a plain tube, the performance of the heat transfer tube of the second embodiment is not less than 2 times higher. In the second embodiment, the bottom portions of the ridges 10 are formed continuously to define the cross portions. Similarly, cross portions may be formed in this manner in the first embodiment and its modification shown in FIGS. 3 and 4.

Figure 14:
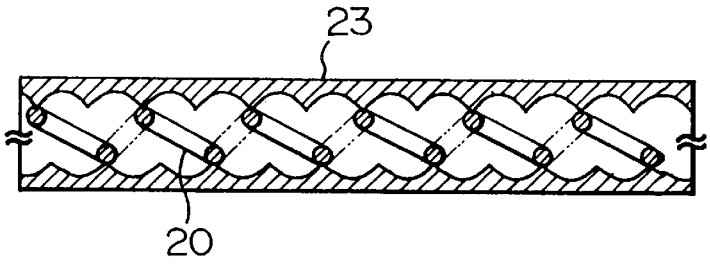
FIG. 14 is a vertical cross-sectional view of a heat transfer tube according to a third embodiment of the invention.
Figure 15:
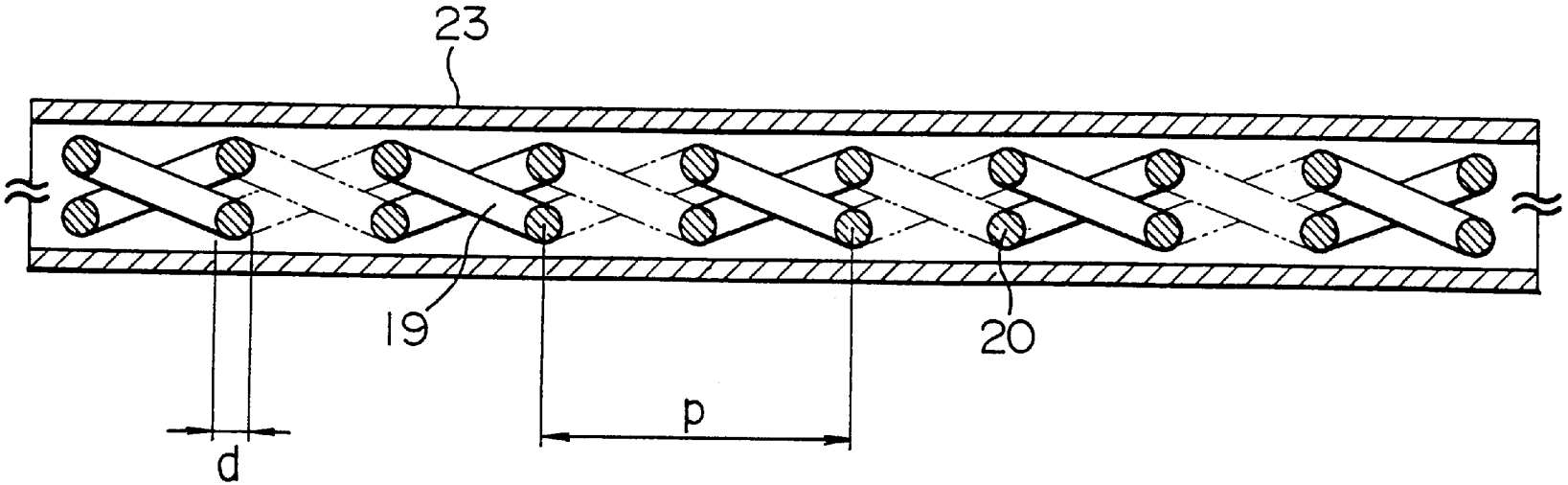
FIG. 15 is a vertical cross-sectional view showing a modification of the third embodiment of FIG. 14.

A third embodiment according to the invention will now be described with reference to FIGS. 14 to 16. FIG. 14 is a vertical cross-sectional view of a heat transfer tube in the third embodiment; FIG. 15 is a vertical cross-sectional view showing a modification of the third embodiment of FIG. 14; and FIG. 16 is a graph showing test results.

When a zeotropic refrigerant mixture is employed, insertion of spring-like members in a tube 23 with inner grooves can be suggested as another method for producing the same effect as grooves having cross portions or independent projections which are formed on the inner surface of a heat transfer tube. FIG. 14 shows one example of such a tube. When a helical direction of the inner grooves is the same as a winding direction of the springs, the inner grooves and the springs intersect each other at a large angle. When the helical direction of the inner grooves is different from the winding direction of the springs, a winding pitch of the springs is determined to form a large number of intersecting portions. Further, as shown in FIG. 15, two or more kinds of springs 19, 20 having different winding directions may be inserted in a tube with a plain inner surface, to thereby provide intersecting portions in the heat transfer tube. When the springs 19, 20 are closely fitted to the inner wall of the heat transfer tube, the springs 19, 20 produce similar effects to the uneven heat transfer surface so that the stirring effect of the refrigerant and the high heat transfer coefficient can be expected. When springs having a winding diameter smaller than the inner diameter of the heat transfer tube are each fixed on the inner wall of the heat transfer tube at one point or several points, flows of the refrigerant cause the springs to vibrate, thus stirring the refrigerant in the vicinity of the wall surface. Therefore, the diffusion resistance when the zeotropic refrigerant mixture is used can be expected to decrease effectively.

Moreover, in the condensation process, condensed liquid flows can be drained along the springs. In the evaporation process, the springs can promote stirring of the liquid and assist generation of bubbles and their release from the tube wall, thereby improving the evaporation heat transfer character.

Figure 16:
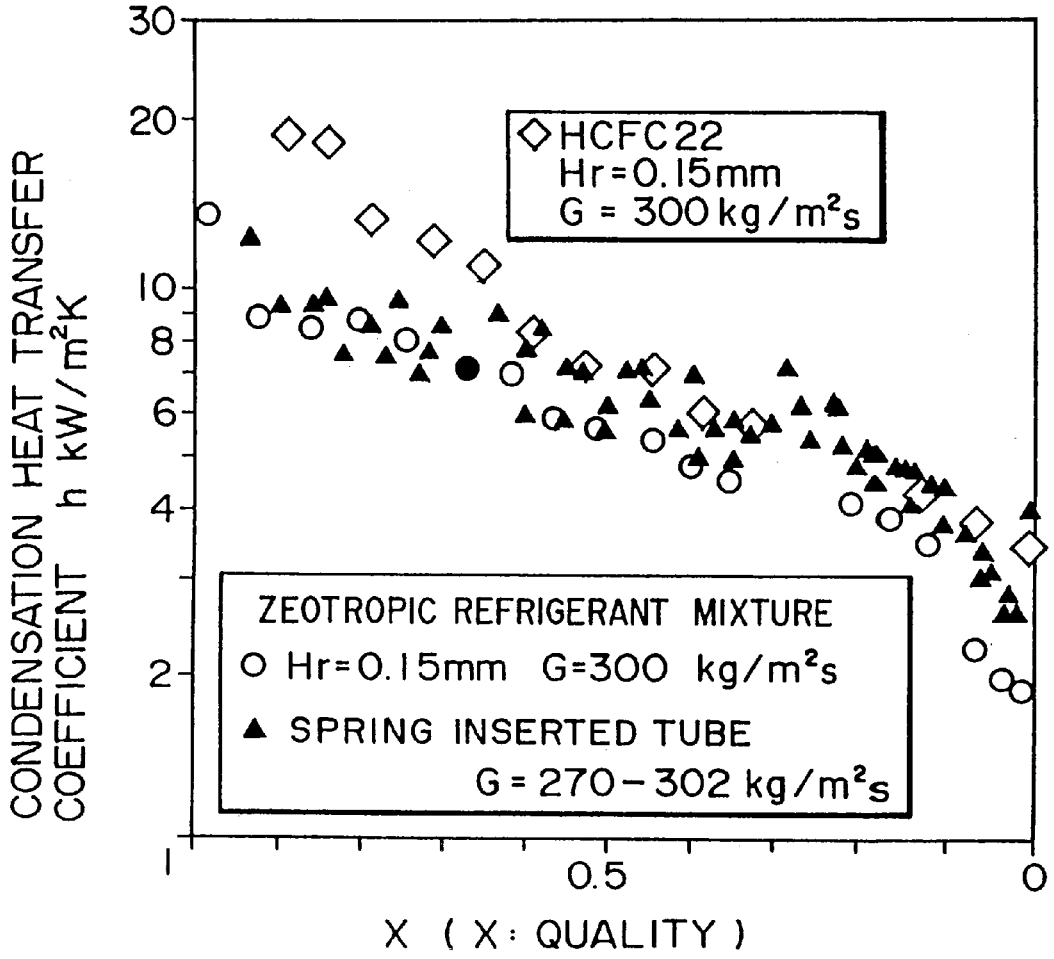
FIG. 16 is a graph showing results when the heat transfer tube in which spring coils are inserted is used for a zeotropic refrigerant mixture in the third embodiment.

FIG. 16 shows one example of results of a test in which spring coils having a wire diameter d of 0.3 mm, a pitch p of 3.0 mm and a coil outer diameter $D_c$ of 6.0 mm are inserted in a tube with inner grooves having a ridge height $H_r$ of 0.15 mm and a helical angle of 18°, and such a heat transfer tube is used for a zeotropic refrigerant mixture. In FIG. 16, the abscissa represents the quality X, and the ordinate represents the condensation heat transfer coefficient. The left-end side of FIG. 16 indicates the inlet of a condenser whereas the right-end side thereof indicates the outlet of the condenser. It can be understood from FIG. 16 that as the phase change takes place and the quality decreases, the heat transfer coefficient is decreased. When compared with the heat transfer coefficient of a tube with inner grooves shown in FIG. 16, the performance of the spring-inserted tube in the vicinity of the outlet of the heat exchanger is improved. In the case of single-phase flows, the maximum effect is obtained when the ratio p/d of the spring pitch p with respect to the element wire diameter d of the springs is 10 to 20. However, according to the results of this test with the zeotropic refrigerant mixture, the maximum effect is obtained when the ratio p/d is 10.

The spring coils may be made of a single wire or of a stranded wire, and also, they may be coiled at a small pitch in the longitudinal direction such as a double spring or be bent. The wire of the spring coils may be changed in diameter or deformed in the longitudinal direction. The winding pitch of the springs can be made constant over the entire length. Other than that, the winding pitch of the springs may be changed partially or changed gradually along a direction of flows of the refrigerant. When the springs are formed in accordance with the condition of the refrigerant in the above-described manner, the performance of the heat transfer tube can be improved all over its length.

Figure 17:
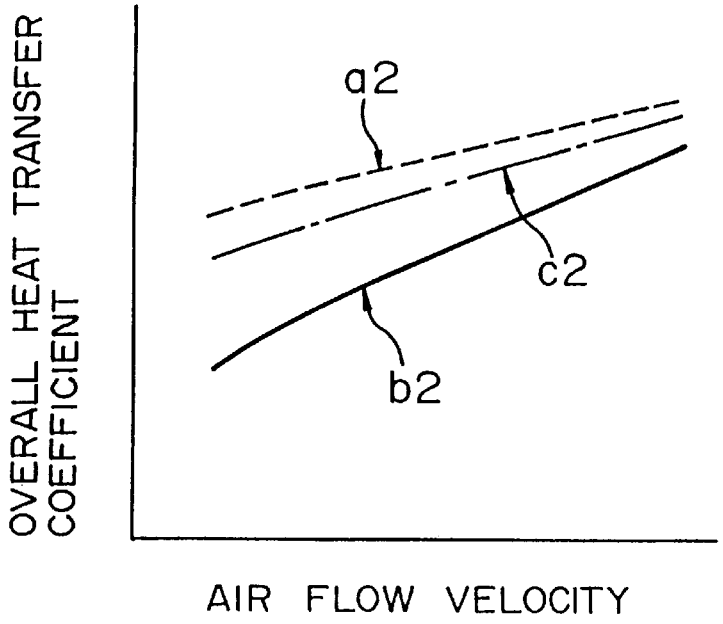
FIG. 17 is a graph for comparing the performances of various kinds of heat exchangers, in which the abscissa represents the air flow velocity, and the ordinate represents the overall heat transfer coefficient.

Next, a heat exchanger will be described. Since the heat exchanger shown in FIG. 1 is made of the above-described heat transfer tubes, the performance of the heat exchanger is higher than that of the conventional heat exchanger when a zeotropic refrigerant mixture is used. The overall heat transfer coefficient expresses the general heat transfer performance of a heat exchanger. The air-side heat transfer coefficient, the refrigerant-side heat transfer coefficient, the contact heat resistance and so forth affect the overall heat transfer coefficient. FIG. 17 is a graph for comparing the performances of various kinds of heat exchangers, in which the abscissa represents the air flow velocity, and the ordinate represents the overall heat transfer coefficient. In FIG. 17, a curve a2 indicates the case where a single refrigerant HCFC-22 flows in conventional tubes with helical grooves, a curve b2 indicates the case where a zeotropic refrigerant mixture flows in conventional tubes with helical grooves, and a curve c2 indicates the case where a zeotropic refrigerant mixture flows in heat transfer tubes according to the present invention. As clearly understood from FIG. 17, the performance of the conventional tubes with helical grooves is drastically deteriorated when the zeotropic refrigerant mixture is used, but the heat transfer tubes according to the invention can provide an overall heat transfer coefficient close to that of the conventional tubes when the single refrigerant HCFC-22 is used.

Figure 18:
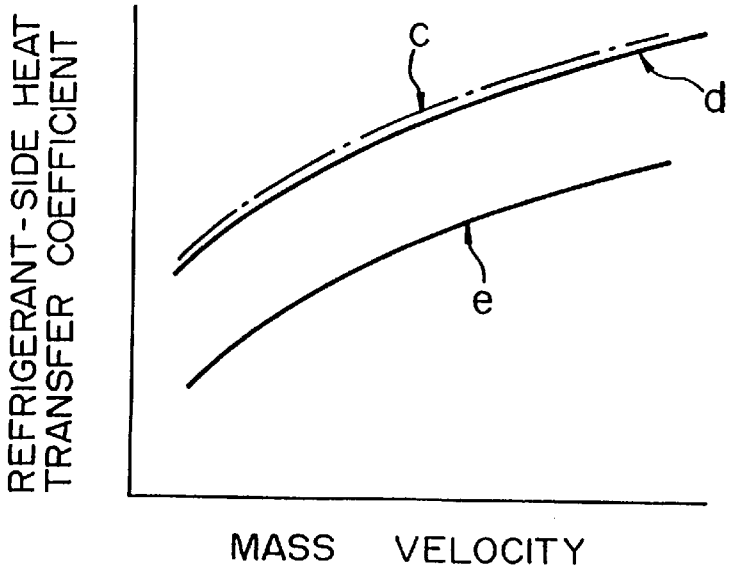
FIG. 18 is a graph for comparing the performances of various kinds of heat exchangers, in which the abscissa represents the mass velocity of the refrigerant, and the ordinate represents the refrigerant-side heat transfer coefficient.

When the heat transfer tubes according to the invention are assembled into a heat exchanger of a cross-fin tube type, as shown in FIG. 1, the heat transfer tubes and fins must be securely fixed to each other. Conventionally, heat transfer tubes have often been expanded mechanically by a mandrel. However, the inner surfaces of the heat transfer tubes according to the invention have complicated shapes, and when the tubes are mechanically expanded, they are deformed. As a result, it is feared that the performance will be largely deteriorated. FIG. 18 shows differences in the refrigerant-side heat transfer coefficient when the heat transfer tubes according to the invention are expanded by different methods, in which a curve c indicates the performance before expanding the tubes, a curve d indicates the performance after expanding the tubes by a fluid pressure, and a curve e indicates the performance after expanding the tubes mechanically. As shown in FIG. 18, the tubes expanded by the fluid pressure can maintain substantially the same performance as the tubes before expanded, and consequently, it is desirable to apply the fluid pressure expanding method to the invention tubes having complicated shapes. The fluid pressure expanding method comprises the steps of: making the heat transfer tubes penetrate through the fins; and applying a fluid pressure to the inner surfaces of the heat transfer tubes, thereby expanding the tubes and securely fixing the heat transfer tubes and the fins to each other.

Figure 19:
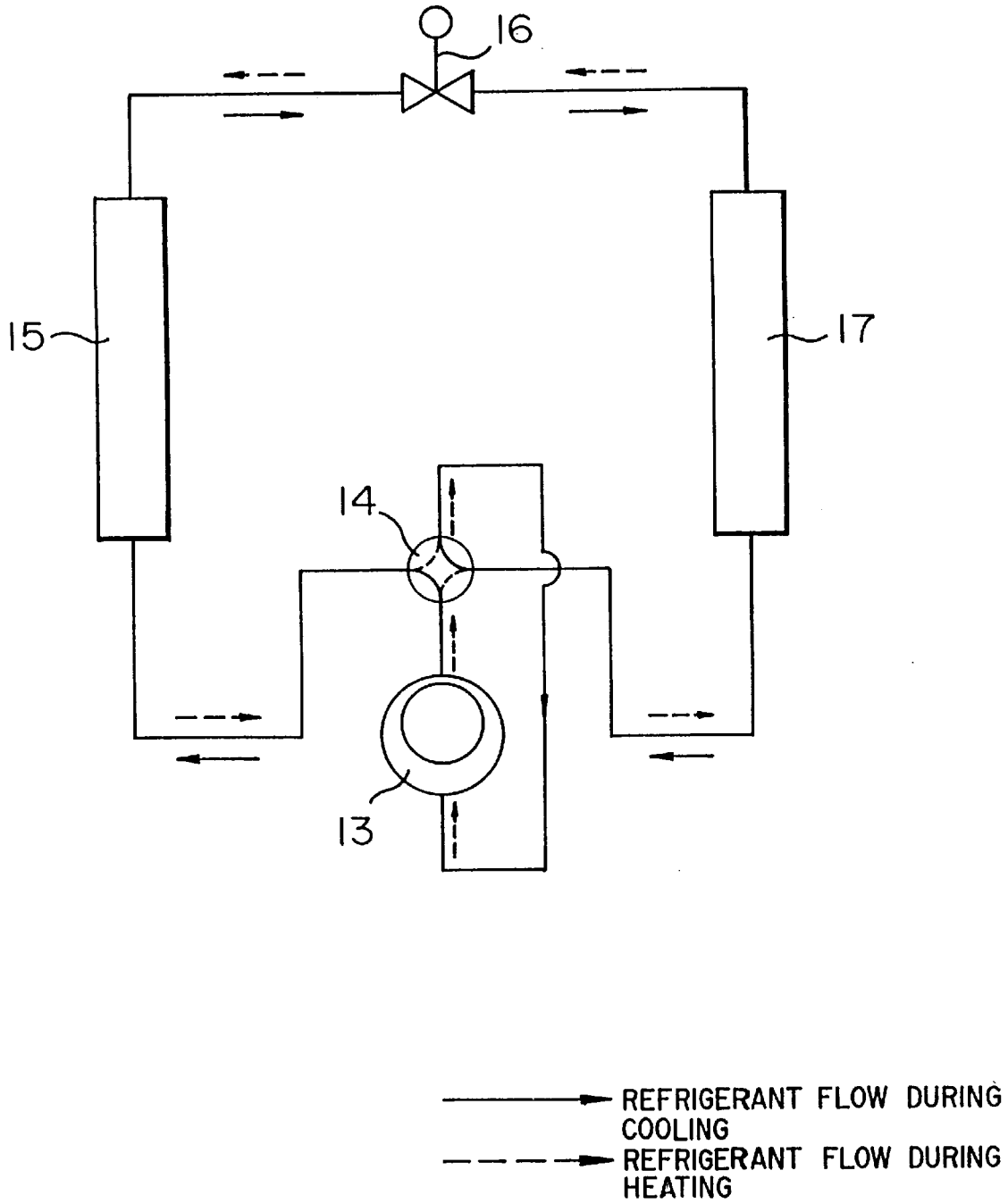
FIG. 19 is a diagram showing a heat pump type refrigeration cycle.
Figure 20:
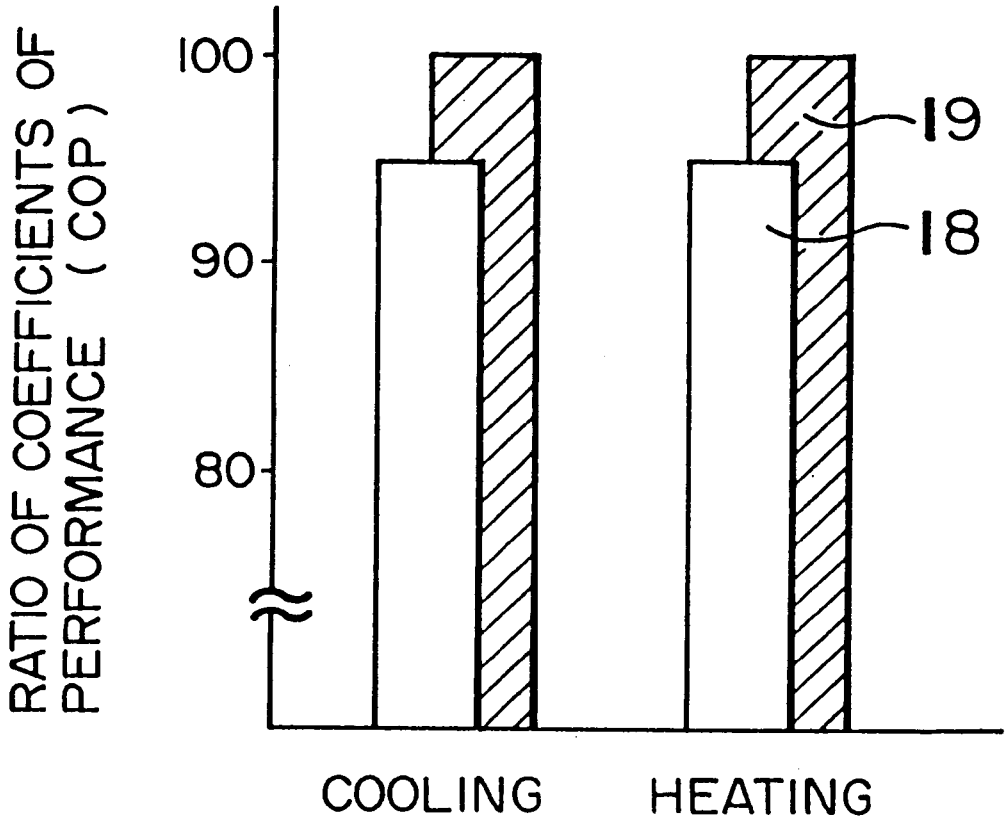
FIG. 20 is a graph for comparing the performance of a conventional air conditioner with that of an air conditioner according to the invention.

Application of heat exchangers according to the present invention to an air conditioner with a zeotropic refrigerant mixture will now be described. FIG. 19 is a diagram showing the structure of a heat pump refrigeration cycle with a zeotropic refrigerant mixture. At the time of cooling operation, an indoor heat exchanger 17 functions as an evaporator, and an outdoor heat exchanger 15 functions as a condenser. At the time of heating operation, the indoor heat exchanger 17 functions as a condenser, and the outdoor heat exchanger 15 functions as an evaporator. FIG. 20 shows, in terms of ratios of coefficients of performance, the cooling and heating performances of the heat exchangers according to the invention and of conventional heat exchangers when they are used as the indoor and outdoor heat exchangers. In this case, the coefficient of performance (COP) is defined by a resultant value when the cooling or heating capacity is divided by the total electricity input. The ratio of coefficients of performance (%) is obtained by preparing a coefficient of performance when a single refrigerant HCFC-22 is used for the conventional heat exchangers as a reference value, and deriving ratios of coefficients of performance of the heat exchangers according to the invention and of the conventional ones with respect to the reference value when a refrigerant mixture consisting of three kinds of refrigerants HFC-32, HFC-125 and HFC-134a by the amount of 30 wt %, 10 wt % and 60 wt %, respectively, is used as a zeotropic refrigerant mixture. As easily understood from FIG. 20, the performance of the conventional air conditioner is largely deteriorated when the zeotropic refrigerant mixture is used, but the air conditioner according to the invention can exhibit substantially the same performance as the conventional one with the single refrigerant.

According to the present invention, as has been described heretofore, a heat transfer tube used for a heat exchanger of a condenser or an evaporator in a refrigeration cycle with a zeotropic refrigerant mixture includes three-dimensional projections, segmental fins or louvered fins which are formed on the inner surface of the tube and project into the vapor flow or liquid thin-layer flow, so that new concentration boundary layers are developed from the distal ends of these projections, to thereby decrease the diffusion resistance. As a result, there can be provided a heat transfer tube of a high heat transfer performance when the zeotropic refrigerant mixture is used.

Moreover, according to the invention, a heat transfer tube with cross grooves for a refrigerant mixture includes inner grooves having cross portions where the grooves intersect with each other, or a plurality of independent projections formed on the inner surface thereof, so as to decrease non-uniformity in the concentration distribution generated in the zeotropic refrigerant mixture, and also to promote stirring of the liquid thin layer flow. In consequence, there can be provided a heat transfer tube for a zeotropic refrigerant mixture which has a high heat transfer coefficient. This effect can be confirmed by the example shown in FIG. 9 in which the heat transfer coefficient is improved over a wide range of the mass velocity.

Furthermore, according to the invention, the refrigerant-side heat transfer coefficient can be maintained at a high level in a refrigeration cycle with a zeotropic refrigerant mixture, so that there can be provided a heat exchanger for a zeotropic refrigerant mixture which exhibits a high heat transfer performance.

By using heat exchangers according to the invention, there can be provided a refrigerator and an air conditioner which have high coefficients of performance (COP).

We claim:

1. A refrigeration cycle comprising:

a compressor;

a first heat exchanger connection with said compressor; and a second heat exchanger connected, at one end, with said first heat exchanger through an expansion means, and at another end, with said compressor;

wherein at least one heat transfer tube of at least one of the first heat exchanger and the second heat exchanger is provided on an inner surface with a plurality of helical ridges which extend at a helical angle $\alpha$ of 10 degrees to 20 degrees with respect to the axis of the tube, said ridges having a pitch Pf1 such that when an inner diameter of the heat transfer tube is denoted by Di, a ratio Pf1/Di is within a range of 0.05 to 0.1, and secondary grooves which cross the ridges, said secondary grooves having a depth Hf2 which is set within a range of 40 to 100% of a height Hf1 of said ridges, a width Wf2 which is set between a top width Wt of said ridges and a bottom width Wb of said ridges, and a cross-sectional shape which provides said ridges with said secondary grooves with a heat transfer area which is not less than a heat transfer area without said secondary grooves.

2. A refrigeration cycle according to claim 1, further comprising a zeotropic refrigerant mixture circulating in said refrigeration cycle.

3. A refrigeration cycle according to claim 1, wherein a ratio Wt/Wb is not more than 0.5.

4. A refrigeration cycle according to claim 1, wherein an angle $\beta$ at which said secondary grooves cross said helical ridges is 1.5 to 4 times larger than said helical angle $\alpha$.

5. A refrigeration cycle comprising:

a compressor;

a first heat exchanger connected with said compressor; and a second heat exchanger connected, at one end, with said first heat exchanger through an expansion means, and at the another end, with said compressor;

wherein at least one heat transfer tube of at least one of the first heat exchanger and the second heat exchanger is provided on an inner surface with a plurality of helical ridges and secondary grooves having a width Wf2 which is set between a top width Wt of said ridges and a bottom width Wb of the ridges, said secondary grooves having a cross-sectional shape which provides said rides with said secondary grooves with a heat transfer area which is not less than a heat transfer area without said secondary grooves.

6. A refrigeration cycle according to claim 2, further comprising a zeotropic refrigerant mixture circulating in said refrigeration cycle.

* * * * *